US011081844B2

(12) United States Patent
Byrne et al.

(10) Patent No.: US 11,081,844 B2
(45) Date of Patent: Aug. 3, 2021

(54) ELECTRICAL POWER AND CONTROL UNIT FOR WORK AREAS

(71) Applicants: Norman R. Byrne, Ada, MI (US); Joshua D. Kizer, Lowell, MI (US); Joseph Castiglione, Rockford, MI (US)

(72) Inventors: Norman R. Byrne, Ada, MI (US); Joshua D. Kizer, Lowell, MI (US); Joseph Castiglione, Rockford, MI (US)

( * ) Notice: Subject to any disclaimer, the term of this patent is extended or adjusted under 35 U.S.C. 154(b) by 0 days.

(21) Appl. No.: 16/545,491

(22) Filed: Aug. 20, 2019

(65) Prior Publication Data

US 2020/0067238 A1 Feb. 27, 2020

Related U.S. Application Data

(60) Provisional application No. 62/858,950, filed on Jun. 7, 2019, provisional application No. 62/720,480, filed on Aug. 21, 2018.

(51) Int. Cl.

| | |
|---|---|
| ***H01R 13/66*** | (2006.01) |
| ***H01R 13/70*** | (2006.01) |
| ***H01R 27/02*** | (2006.01) |
| *H05B 47/105* | (2020.01) |

(52) U.S. Cl.

CPC ..... *H01R 13/6683* (2013.01); *H01R 13/70* (2013.01); *H01R 27/02* (2013.01); *H05B 47/105* (2020.01)

(58) Field of Classification Search

CPC .... H01R 13/6683; H01R 13/70; H01R 27/02; H05B 47/105

See application file for complete search history.

(56) References Cited

U.S. PATENT DOCUMENTS

| | | | |
|---|---|---|---|
| 7,182,633 | B2 | 2/2007 | Byrne |
| 7,559,795 | B2 | 7/2009 | Byrne |
| 8,444,432 | B2 | 5/2013 | Byrne |
| 8,480,429 | B2 | 7/2013 | Byrne |
| 9,312,673 | B2 | 4/2016 | Byrne |
| 9,652,014 | B2 | 5/2017 | Warwick et al. |
| 10,070,736 | B2 | 9/2018 | Byrne et al. |
| 10,425,236 | B2 | 9/2019 | Byrne et al. |
| 10,468,860 | B2 | 11/2019 | Byrne et al. |
| 10,541,557 | B2 | 1/2020 | Byrne et al. |

(Continued)

OTHER PUBLICATIONS

Zenbooth, The 2018 Executive Booth Information Guide, believed to have been published Mar. 15, 2018.

*Primary Examiner* — Jean F Duverne

(74) *Attorney, Agent, or Firm* — Gardner, Linn, Burkhart & Ondersma LLP

(57) ABSTRACT

An electrical power or electronic data unit is provided for mounting in an isolated work space such as a work pod that is at least partially enclosed by walls or other surfaces. The unit includes a housing body, an electrical power outlet and/or an electronic data connector, and an occupancy sensor that is in communication with a controller. The controller is operable to energize and de-energize a lighting or ventilation system associated with the isolated work space in response to a signal received from the occupancy sensor, and may further be operable to energize and de-energize the power outlet or data connector. Optionally, an environmental sensor is provided with the unit, and is in communication with a building automation system.

19 Claims, 6 Drawing Sheets

(56) References Cited

U.S. PATENT DOCUMENTS

| | | | | |
|---|---|---|---|---|
| 10,621,113 | B2 | 4/2020 | Byrne et al. | |
| 10,653,014 | B2 * | 5/2020 | Spiro | F21V 23/0442 |
| 2004/0026998 | A1 | 2/2004 | Henriott et al. | |
| 2010/0295482 | A1 * | 11/2010 | Chemel | H05B 47/155 315/312 |
| 2012/0127637 | A1 | 5/2012 | Byrne | |
| 2019/0035569 | A1 * | 1/2019 | Sadwick | H05B 47/10 |
| 2019/0148850 | A1 | 5/2019 | Byrne et al. | |
| 2019/0320515 | A1 * | 10/2019 | Sadwick | H05B 47/11 |
| 2019/0372357 | A1 | 12/2019 | Byrne et al. | |

* cited by examiner

ELECTRICAL POWER AND CONTROL UNIT FOR WORK AREAS

CROSS REFERENCE TO RELATED APPLICATIONS

The present application claims the benefit of U.S. provisional application, Ser. No. 62/720,480, filed Aug. 21, 2018 and U.S. provisional application, Ser. No. 62/858,950, filed Jun. 7, 2019, both of which are hereby incorporated herein by reference in their entireties.

FIELD OF THE INVENTION

The present invention relates to electrical systems and components for use in small isolated work areas, in particular for work areas having their own dedicated lighting, ventilation, electrical power, or electronic data ports.

BACKGROUND OF THE INVENTION

Isolated work areas, which may be fully enclosed or at least partially enclosed, are becoming more common for use by individuals or small groups of people, such as 2-4 people. Single-user work areas may resemble enclosed or partially-enclosed phone booths, for example. These isolated work areas may be called "work pods" or "work booths", and may be equipped with their own lighting, ventilation, electrical power outlets, electronic data ports, video display screens, and the like. Other work areas include partially walled-off or otherwise demarcated zones (such as zones serviced by individual ventilation or lighting units) within a larger work area.

SUMMARY OF THE INVENTION

The present invention provides an electrical power and/or data unit that receives electrical power from an outside power source, such as electrical mains associated with a building or vehicle in which the unit is mounted, and which is mountable in a work pod or booth or within a zone of a work area for providing users with access to electrical power, such as for running laptop computers or charging portable electronic devices, and which can be used to selectively energize a ventilation and/or lighting system associated with the work pod or booth or area. The unit includes an environmental sensor and timer that cooperate to de-energize components in the pod or booth when the sensor has not detected the presence of a user in the pod or booth for a predetermined amount of time, which may vary according to time of day, day of the week, or other factors. Thus, electric fans, lighting, video displays, and even electrical outlets may be automatically de-energized to conserve energy when a given booth or pod is not in use. The unit may also include one or more switches that allow a user to manually control one or more components of the pod or booth, such as lighting, ventilation, a video display, and electrical outlets. The unit may further include a wire pass-through so that separate wiring and/or a connector may be provided at the unit, or so that a user may route their own wire (such as an Ethernet or HDMI cable, or a power extension cord) through a wall of the pod or booth for connection to an outside source or receiving point.

In one form of the present invention, an electrical power and/or electronic data unit is provided for mounting in an isolated work space such as a fully or partially enclosed work pod. The unit includes a housing body, an electrical power outlet or electronic data outlet mounted at the housing body, and an environmental sensor for detecting an environmental factor near the housing body. The environmental sensor can detect an environmental factor such as occupancy, air temperature, and humidity, and can communicate a signal indicative of the detected environmental factor to a receiver. The receiver communicates with a controller that is operable to selectively energize and de-energize a ventilation unit, lighting, or the electrical power outlet or electronic data outlet of the isolated work space.

According to one aspect, the unit further includes an override switch that cooperates with the controller to energize an environmental power conductor for supplying electrical power to the ventilation unit or the lighting, regardless of whether or not the environmental sensor detects non-occupancy of the isolated work space.

According to another aspect, a front face of the unit defines a wire pass-through opening.

According to yet another aspect, the unit includes both a high voltage AC power outlet and a low voltage DC power outlet.

According to still another aspect, the receiver is in communication with a data logger that is in communication with a building automation system.

In another form of the present invention, an electrical power and/or electronic data unit is provided for mounting in an isolated work space, and includes a housing body with a front face, an electrical power outlet mounted at the front face, and an occupancy sensor for detecting an environmental factor in a vicinity of the housing body and for generating an occupancy signal. A controller in communication with the occupancy sensor receives the occupancy signal and can selectively energize or de-energize a ventilation system or a lighting system of the isolated work space in response to the occupancy signal.

Thus, the electrical power or electronic data unit provides users with access to electrical power and/or electronic data connectivity in a comfortable work environment, while also reducing unnecessary energy consumption by de-activating one or more systems associated with an isolated work environment, such as a pod-style work area, when the systems are not needed.

These and other objects, advantages, purposes and features of the present invention will become apparent upon review of the following specification in conjunction with the drawings.

BRIEF DESCRIPTIONS OF THE DRAWINGS

DESCRIPTION OF THE PREFERRED EMBODIMENTS

Figure 1:
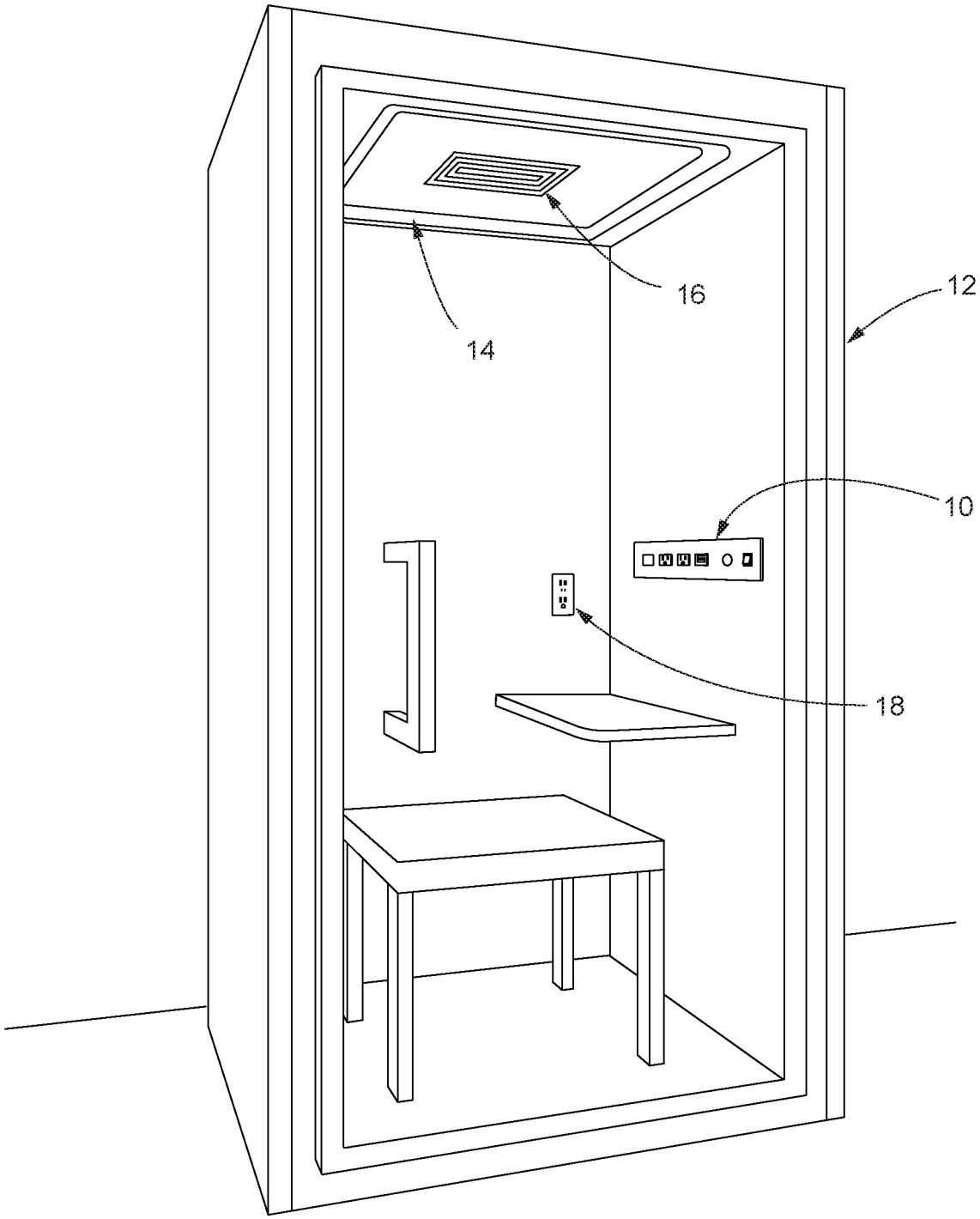
FIG. 1 is a perspective view of a fully enclosed work pod including an electrical power unit in accordance with the present invention.
Figure 2:
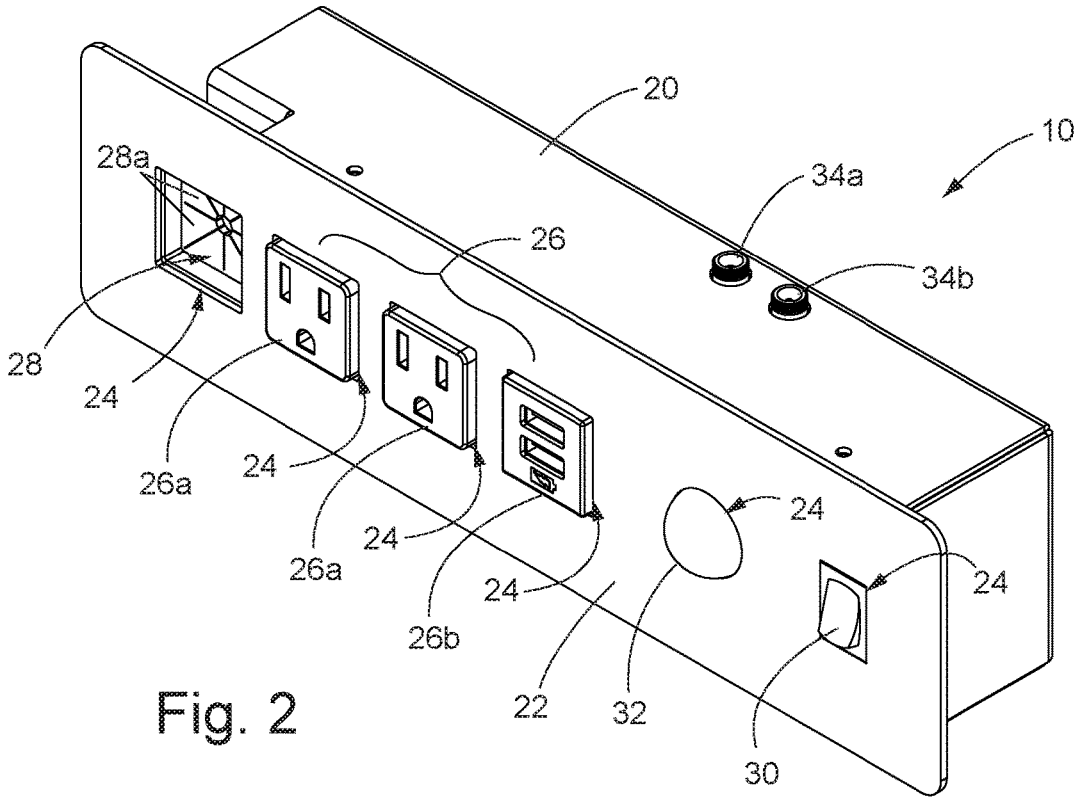
FIG. 2 is a top-front perspective view of the electrical power unit of FIG. 1.
Figure 3:
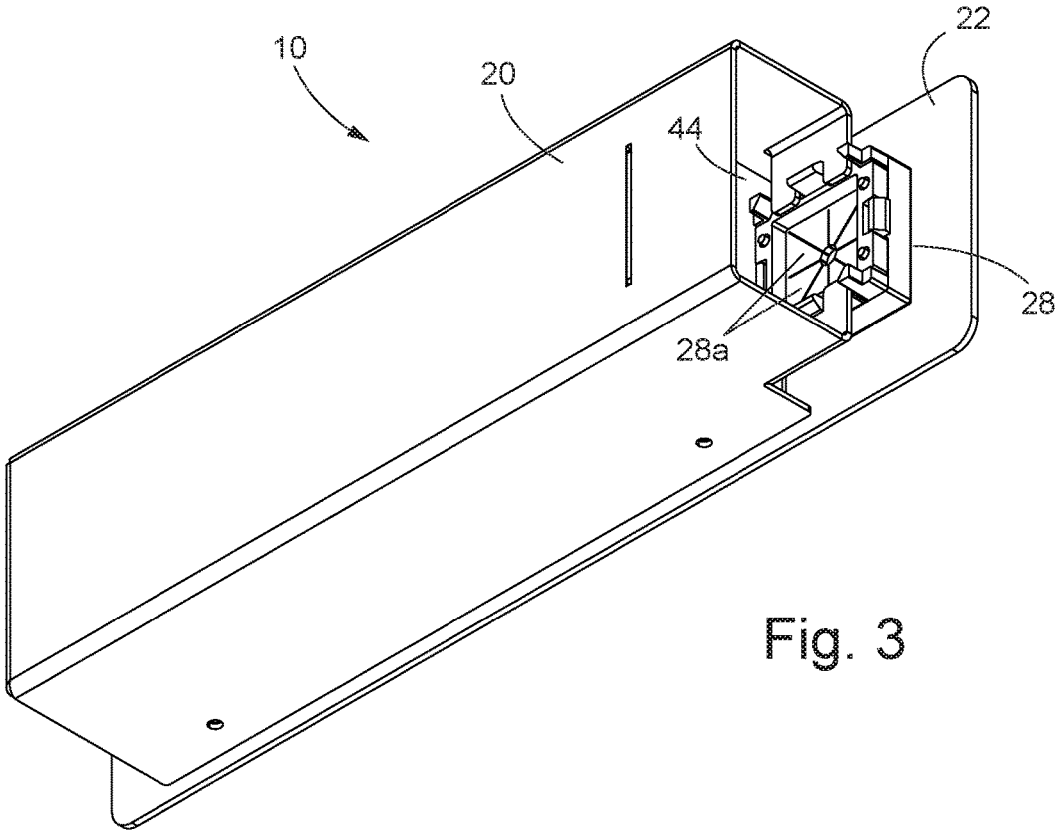
FIG. 3 is a bottom-rear perspective view of the electrical power unit.
Figure 5:
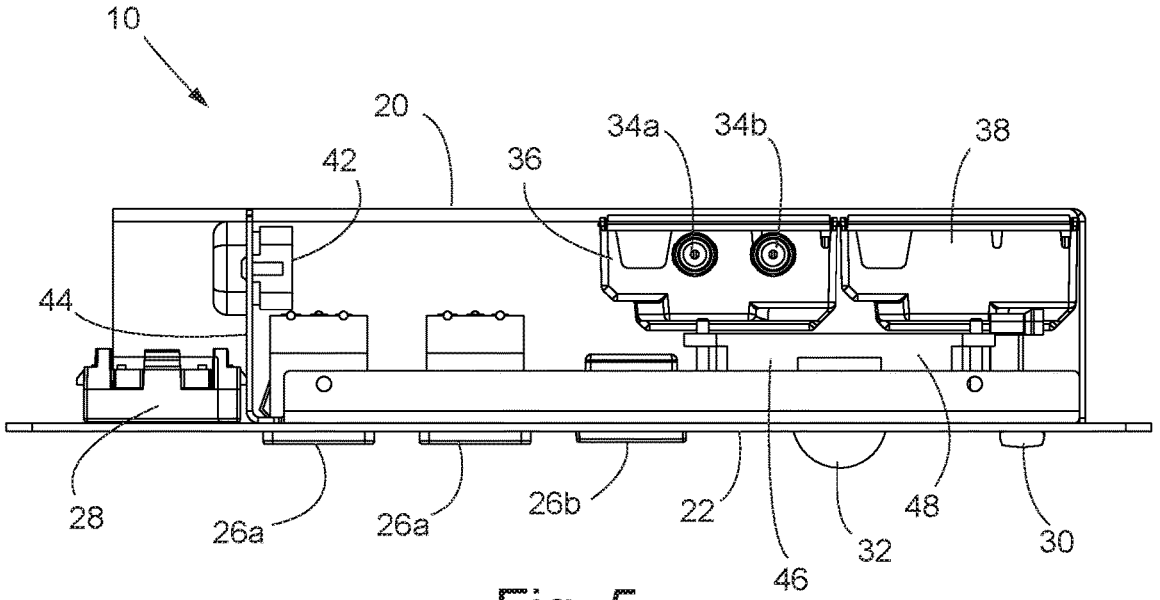
FIG. 5 is a top plan view of the electrical power unit, with housing portions shown as transparent to depict internal structure.
Figure 6:
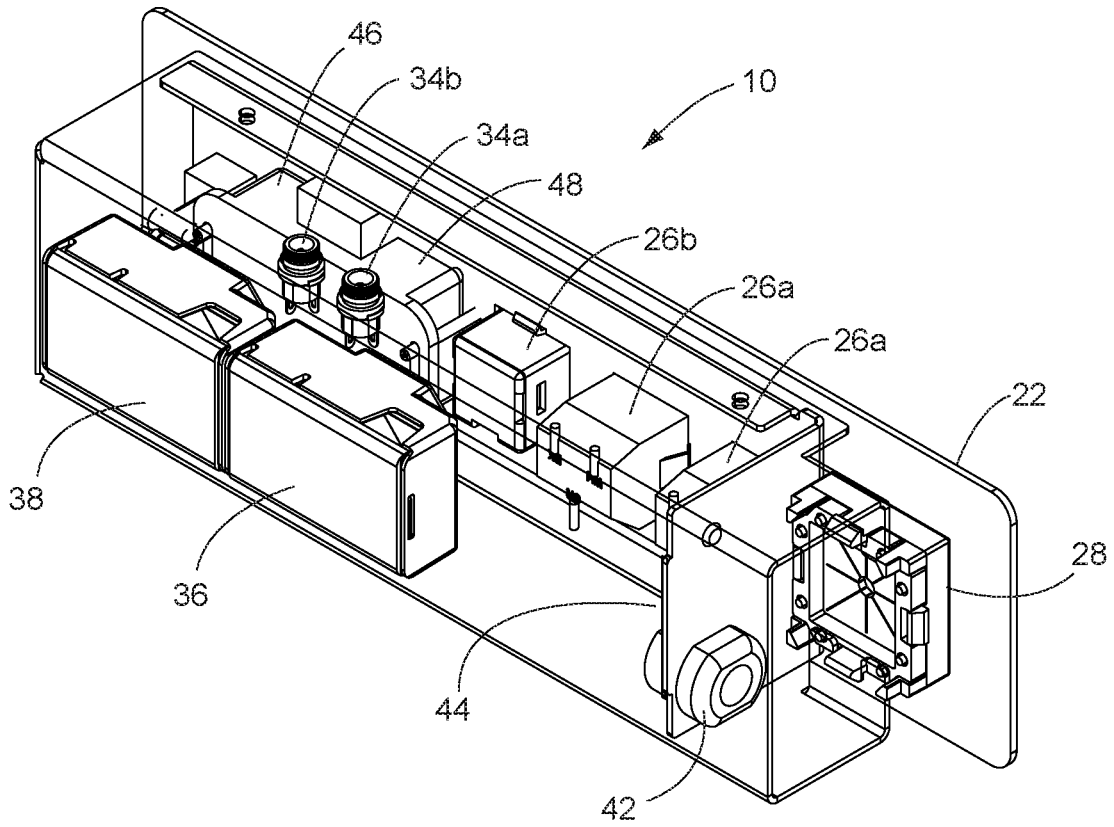
FIG. 6 is a top-rear perspective view of the electrical power unit, with housing portions shown as transparent to depict internal structure.

Referring now to the drawings and the illustrative embodiments depicted therein, an electrical power and/or electronic data and control unit 10 is configured for mounting in an isolated work space or work pod 12 that is defined by a plurality of panels within a larger area, such as shown in FIG. 1. The work pod 12 may include electric lighting 14, an electric powered ventilation system 16, and one or more electrical power outlets 18, in addition to a shelf or a table surface, seating, a video display screen (not shown), and the like. The power and control unit 10 includes a housing 20 with a front face plate 22 that is exposed in the interior of the work pod 12, with the face plate 22 defining a plurality of openings 24 in which various devices are mounted (FIG. 2), as will be described below. The power and control unit 10 provides users of the work pod 12 with access to useful features such as electrical power outlets 26 (including high voltage AC simplex outlets 26*a* and low voltage DC outlets 26*b*, in the illustrated embodiment), a wiring pass-through 28, and an override or power switch 30 (FIGS. 2 and 5). In addition, an environmental sensor face 32 is positioned at a circular opening 24 in the face plate 22.

Figure 4:
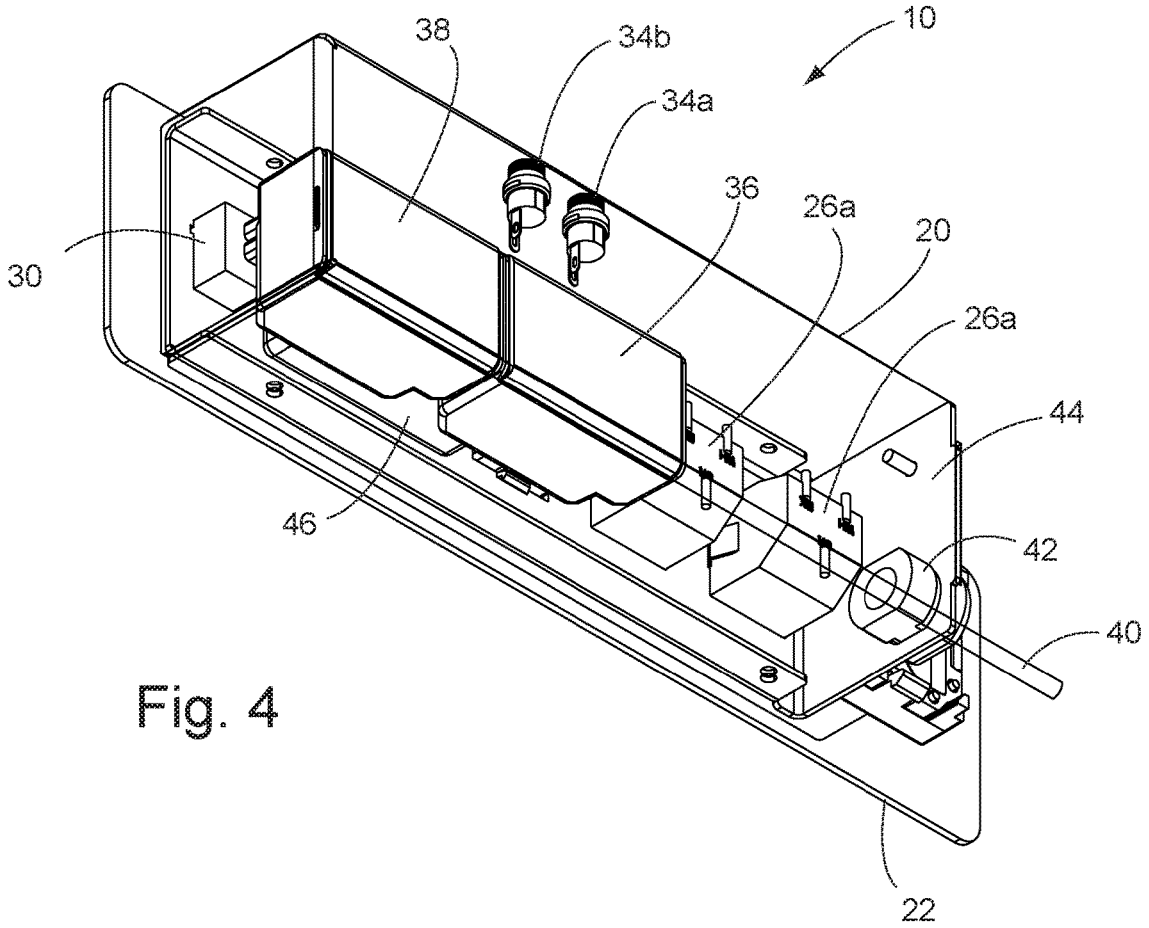
FIG. 4 is another bottom-rear perspective view of the electrical power unit, with housing portions omitted or shown as transparent to depict internal structure.

A pair of selectively energizable electrical power ports or couplers 34*a*, 34*b* are provided along a top surface of the housing 20, and are provided for supplying electrical power to environmental devices such as ventilation system 16 and lighting 14. Electrical power ports 34*a*, 34*b* may be energized and de-energized simultaneously, or may be independently energized and de-energized if desired for their particular applications. Each electrical power port 34*a*, 34*b* is in electrical communication with an electrical power supply 38 via a respective environmental power conductor (not shown). An electrical power output supply 36 may be selectively energized by the separate power supply 38 that receives a high voltage AC power input via a power cord 40 (FIG. 4) that passes into the housing 20 through a strain relief grommet 42 in an opening formed in an end plate 44 of housing 20. Power supply 38 keeps an environmental sensor 46 (associated with sensor face 32) energized at all times to detect one or more environmental factors of the work pod 12, while power output supply 36 is selectively energized when environmental sensor 46 has detected the presence of an occupant in (or in the vicinity of) the work pod. However, the power output supply 36 may instead be selectively energized by the power cord 40 when environmental sensor 46 has detected the presence of an occupant in (or in the vicinity of) the work pod. Thus, environmental sensor 46 controls the directing of power to at least the power ports 34*a*, 36*b*, but may also control the directing of power to the power output supply 36 and the DC power outlets 26*b*. Optionally, the environmental sensor 46 also controls the directing of power to AC simplex outlets 26*a*, such as via a controllable relay switch that defaults to an open condition.

In applications where low voltage power is desired for operating the work pod's systems or recharging or powering devices within the work pod, power supply 38 may be configured to receive high voltage AC electrical power from cord 40 (FIG. 4), such as 110V or 220V electrical power, and convert this AC power input into a low voltage DC output, such as 5V-24V DC power, that can be supplied to the power output supply 36 and power ports 34*a*, 36*b*, and to low voltage DC electrical power outlet 26*b*. This type of low voltage DC power may be useful for powering low voltage LED bulbs of lighting 14, a DC electrical fan of ventilation system 16, USB-style DC power outlets 26*b*, and the like. Optionally, power output supply 36 supplies continuous power to the DC power outlets 26*b*, although it is also envisioned that power output supply 36 may be energized by the power supply 38 (to thus energize the DC outlets 26*b*) only when the environmental sensor 46 has generated an occupancy signal within a predetermined elapsed time period, as described above.

A controller 48, which may be contained within environmental sensor 46, is in communication with the environmental sensor 46 and with the environmental power conductors of power ports 34*a*, 34*b*. The controller 48 is operable to de-energize one or both of the environmental power conductors 34*a*, 34*b* in response to the environmental sensor detecting non-occupancy of the isolated work space. It will be appreciated that the environmental sensor 46 may generate a non-occupancy signal after not detecting an occupant for a predetermined amount of time, or may halt generating an occupancy signal after not detecting an occupant for a predetermined amount of time, either of which may be considered a "signal" within the meaning of the present specification and claims. Optionally, environmental sensor 46 may be a motion sensor, an infrared sensor, or substantially any type of sensor capable of detecting the presence of a human occupant or of objects (e.g. a mobile phone or portable computer) normally associated with such an occupant. It is further envisioned that the sensor 46 may detect and generate corresponding electronic signals corresponding to air temperature and humidity surrounding the sensor 46, the frequency and duration of detected occupancy of the area in the vicinity of the sensor 46, and the like.

The controller 48 may de-energize the environmental power ports 34*a*, 34*b* at staggered time intervals, such as by first de-energizing the first power port 34*a* to de-energize the ventilation system 16 prior to de-energizing the second power port 34*b* to de-energize the lighting 14. In the event that an occupant is actually present in the work pod 12, the initial de-energizing of ventilation system 16 may provide the occupant with a subtle but readily discernable indication that the lighting 14 may soon be de-energized, so that the occupant can take action (such as actuating switch 30) prior to the lighting 14 being turned off while the occupant is still in the work pod 12. However, the switch 30 may optionally be configured to force the lighting 14 and/or the ventilation system 16 off, regardless of whether or not the environmental sensor 46 detects the presence of an occupant in the work pod 12.

Wiring pass-through 28 is configured to receive and support one or more electrical wires passing through the face 22 for use by an occupant of the work pod. Such wires may include electrical power cords, Ethernet cables, video cables, or substantially any power or signal cable desired, for routing electrical power and/or electronic data into or out of the work pod 12. In the illustrated embodiment, the wiring pass-through 28 is outboard of the end plate 44 of housing 20, so that any wire inserted into the pass-through 28 cannot be inadvertently directed into the interior of the housing 20. Wiring pass-through 28 includes a plurality of resilient fingers 28*a* (FIG. 4) that engage an electrical wire, and that return to a non-flexed position (shown) when the wire is removed therefrom.

Any or all of the power or data outlets 26, the environmental sensor face 32 or associated sensor 46, the switch 30, and the wiring pass-through 28 may all be snap-fit or slide-fit into the front face plate 22 or a structural plate located directly behind the face plate. Such arrangements are more fully described in commonly-owned U.S. Pat. Nos. 8,480,429, 9,312,673, 7,182,633, 7,559,795, and U.S. Publication No. 2012/0127637, which are all hereby incorporated herein by reference in their entireties. Electrical power output supply 36 and power supply 38 may be mounted to an interior surface of a rear panel of the housing 20 with double-sided tape, or via any suitable mechanical fastener or other connection, including slide-mount arrangement such as described in the above-referenced commonly-owned patents and application. Power ports 34*a*, 34*b* are illustrated as barrel connectors secured with respective threaded nuts, although any suitable style and mounting arrangement of electrical connectors are envisioned. Such connectors or ports may be provided along an outer housing surface as shown in FIGS. 2 and 4-6, or may be contained inside of the housing, requiring additional wiring to be routed into the housing, or may be provided at the ends of respective cords extending outside of the housing.

Figure 7:
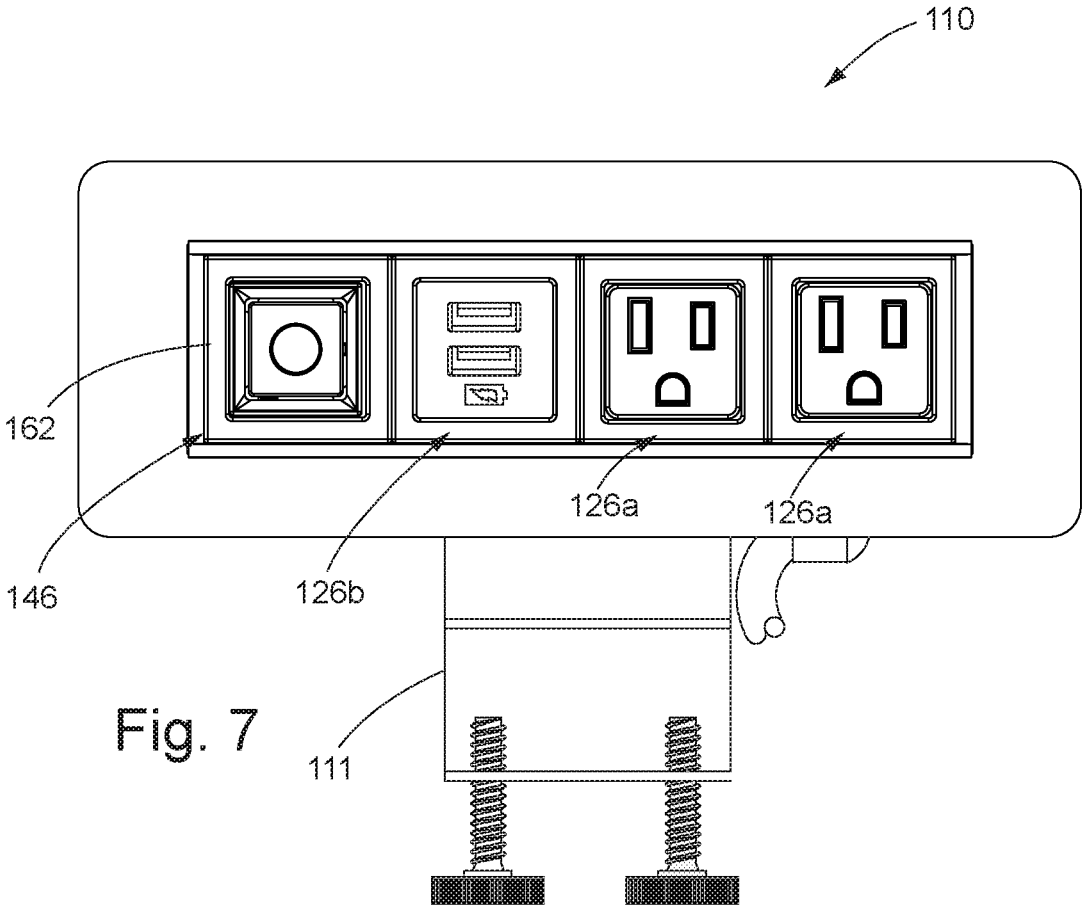
FIG. 7 is a front elevation of another electrical power unit in accordance with the present invention.

Referring to FIG. 7, it is further envisioned that an environmental sensor 146 may be incorporated into an electronic data, power, and control unit 110 that is mountable along tables, desks, divider walls, or other structures within open work areas, or within a surface of pod 12 such as described above. A mounting bracket 111 is optionally provided for securing the unit 110 to other surfaces. Although the illustrated mounting 111 is an edge-mount bracket, it will be appreciated that other types of brackets may be used without departing from the spirit and scope of the present invention. Similar to the unit 10 described above, the unit 110 includes a bezel or front face 122 and supports one or more high voltage AC power outlets 126*a* and one or more low voltage DC power and/or data outlets 126*b* contained in a housing that may be more fully understood with reference to commonly-owned U.S. Pat. Nos. 8,444,432 and 8,480,429, both of which are hereby incorporated herein by reference in their entireties.

Figure 8:
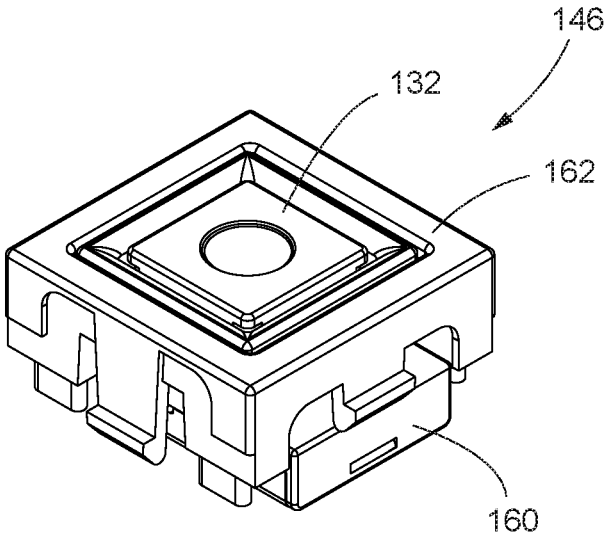
FIG. 8 is a front perspective view of a sensor insert of the electrical power unit of FIG. 7.
Figure 9:
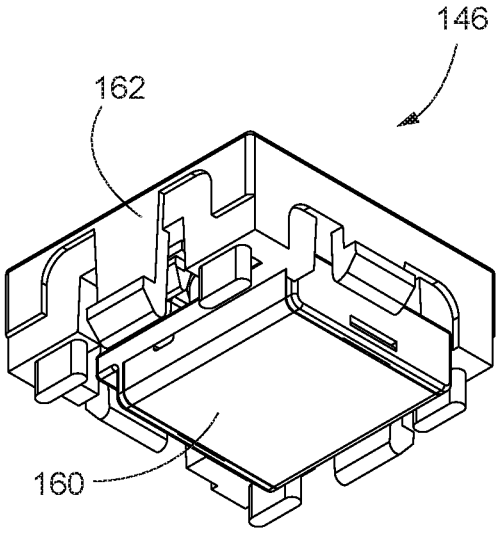
FIG. 9 is a rear perspective view of the sensor insert of FIG. 8.
Figure 10:
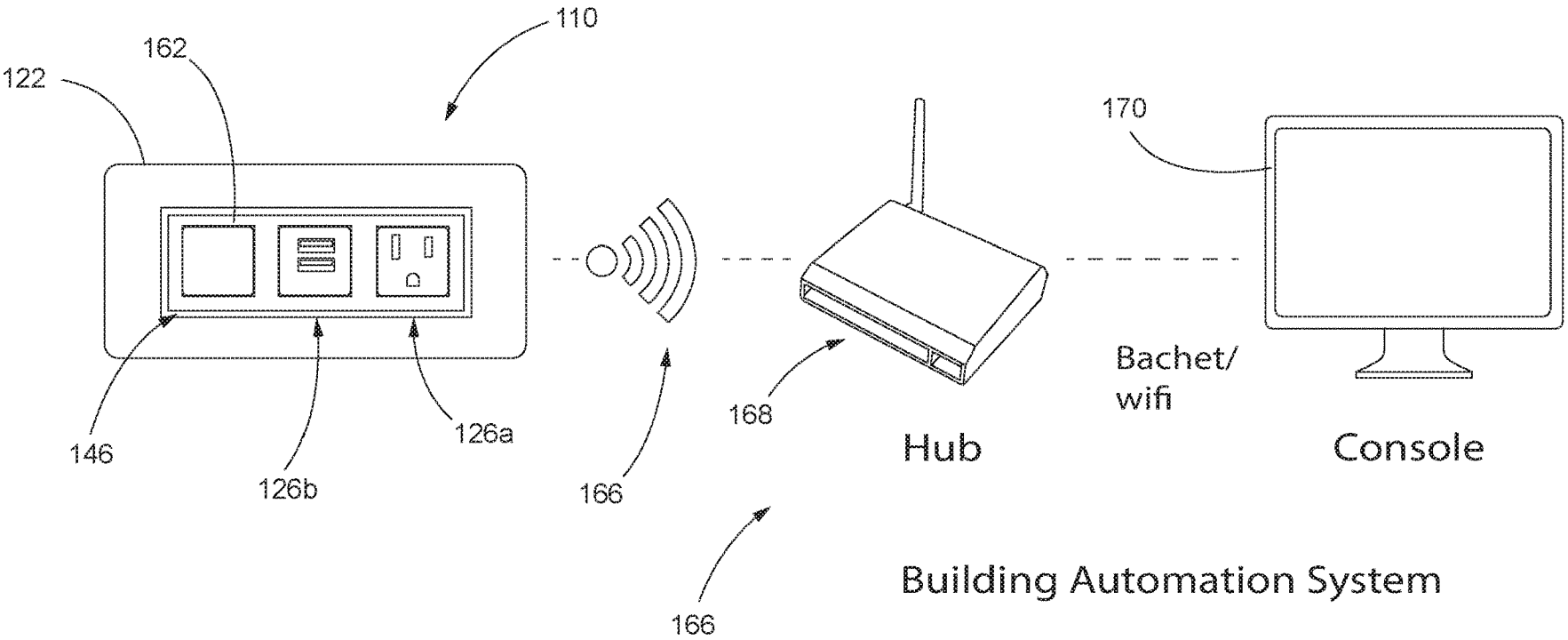
FIG. 10 is a diagram of the electrical power unit of FIG. 7 in communication with a building automation system.

Environmental sensor 146 includes a sensor face 132 and a sensor housing 160 that is mounted in a window housing 162 such as shown in FIGS. 8 and 9. Window housing 162 generally corresponds to the housings described in commonly-owned U.S. Pat. No. 8,444,432, such that the various features of the window housing 162 and its mounting in the unit 110 will not be described herein. Sensor housing 160 contains the electronic circuitry that senses environmental factors and/or occupancy of an area in the vicinity or viewing area of the sensor face 132, and also circuitry that communicates electronic data to a building automation system 164 such as a BACnet protocol system, which is a standard protocol used for building automation and control networks. As shown in FIG. 10, environmental sensor 146 may use wireless communications 166 such as 2.4 GHz ZIGBEE® protocol, BLUETOOTH® protocol, or substantially any other wireless communications protocol, to communicate with the building automation system 164, which may include a wireless data hub 168 and a computer console with display 170.

Information displays, such as power consumption graphs and the like, may be generated by analysis and display software. Data displays themselves, based on data received from environmental sensors 146, may be integrated into existing BACnet displays, so that a person using a local computer can observe and log environmental and/or occupancy data detected by the sensors 146. The ability to log environmental and occupancy data received from one or more sensors 146 distributed in individual work pods or within a larger work area carries numerous potential benefits, including increasing energy efficiency and occupant comfort through temperature and humidity control (e.g., by energizing or adjusting the output of ventilation systems only in occupied zones of a larger work area), reducing the time and costs associated with troubleshooting and servicing environmental control systems by pinpointing problem areas, regulating moisture in the air to prevent mold and other forms of damage building surfaces and furniture, and reducing allergy and asthma triggers, to provide automated light control, to energize computers and other electrical or electronic equipment in an area only when occupied, to selectively energize and de-energize the power outlets 126*a*, 126*b* at the unit 110, and to collect data on room occupancy for space planning purposes.

Thus, the electrical power or electronic data unit of the present invention provides a comfortable isolated work space for a user when the work space is occupied, while also providing power and/or data connectivity for the user in the work space. The system reduces energy consumption by de-activating lighting and/or ventilation and/or electrical power outlets associated with the work space when a no-occupancy condition is detected by an environmental sensor.

Changes and modifications in the specifically-described embodiments may be carried out without departing from the principles of the present invention, which is intended to be limited only by the scope of the appended claims as interpreted according to the principles of patent law including the doctrine of equivalents.

The embodiments of the invention in which an exclusive property or privilege is claimed are defined as follows:

1. An electrical power and/or electronic data unit for mounting in an isolated work space, said electrical power and/or electronic data unit comprising:

a housing body configured for mounting along a surface that defines a boundary of the isolated work space;

at least one electrical power outlet mounted in said housing body, wherein each said outlet is accessible at said housing body;

an environmental sensor mounted at said housing body proximate said at least one electrical power outlet and configured to detect an environmental factor inside the isolated work space in a vicinity of said housing body;

wherein said environmental sensor is configured to:

detect at least one environmental factor, in the isolated work space, chosen from (i) occupancy, (ii) temperature, and (iii) humidity; and communicate a signal indicative of the environmental factor to a receiver that is in communication with a controller configured to selectively energize and de-energize (i) a ventilation unit of the isolated work space, (ii) lighting of the isolated work space, and (iii) the at least one electrical power outlet at said housing.

2. The electrical power and/or electronic data unit of claim 1, further comprising an override switch in communication with the controller, wherein said override switch cooperates with the controller to energize an environmental power conductor that is adapted to supply electrical power to the ventilation unit, the electrical power outlet, and the lighting regardless of said environmental sensor detecting non-occupancy of the isolated work space.

3. The electrical power and/or electronic data unit of claim 2, wherein said override switch is mounted at said housing.

4. The electrical power and/or electronic data unit of claim 1, wherein said housing comprises a front face defining a plurality of openings in spaced arrangement and configured to receive respective ones of said at least one electrical power outlet or electronic data outlet, and said environmental sensor.

5. The electrical power and/or electronic data unit of claim 4, wherein said front face defines a wire pass-through opening.

6. The electrical power and/or electronic data unit of claim 4, wherein said at least one electrical power outlet or electronic data outlet comprises a high voltage AC power outlet and a low voltage DC power outlet.

7. The electrical power and/or electronic data unit of claim 1, wherein said front face is configured to slidably receive said environmental sensor and said at least one electrical power outlet or electronic data outlet mounted mounted in respective window housings.

8. The electrical power and/or electronic data unit of claim 1, further in combination with said controller, said electrical power and/or electronic data unit further comprising a selectively energizable electrical power coupler mounted at said housing and adapted to supply electrical power to a ventilation system or a lighting system at the isolated work space, wherein said power coupler is selectively energized and de-energized by said controller in response to the signal received from said environmental sensor.

9. The electrical power and/or electronic data unit of claim 1, wherein said environmental sensor comprises a motion sensor.

10. The electrical power and/or electronic data unit of claim 1, further in combination with said receiver, wherein said receiver is in communication with a data logger that is in communication with a building automation system.

11. An electrical power and/or electronic data unit for mounting in an isolated work space, said electrical power and/or electronic data unit comprising:

a housing body configured for mounting along a surface that defines a boundary of the isolated work space, said housing body having a front face;

an electrical power outlet mounted at said front face of said housing body;

an occupancy sensor mounted at said housing body proximate said electrical power outlet, said occupancy sensor configured to detect an environmental factor inside the isolated work space in a vicinity of said housing body and to generate an occupancy signal; and a controller in communication with said occupancy sensor, wherein said controller is adapted to receive the occupancy signal and is configured to selectively energize or de-energize a ventilation system, the electrical power outlet, and a lighting system associated with the isolated work space in response to the occupancy signal.

12. The electrical power and/or electronic data unit of claim 11, wherein said electrical power outlet comprises a high voltage AC power outlet and a low voltage DC power outlet.

13. The electrical power and/or electronic data unit of claim 11, further comprising:

an electrical power supply mounted in said housing and configured to continuously receive a high voltage AC power input from a power cord; and an electrical power output supply mounted in said housing and configured to supply electrical power to said electrical power outlet;

wherein said electrical power supply continuously directs electrical power to said occupancy sensor and selectively directs electrical power to the ventilation system or the lighting system in response to the occupancy signal.

14. The electrical power and/or electronic data unit of claim 11, further comprising an environmental sensor at said housing body, said environmental sensor configured to detect air temperature or humidity in a vicinity of said housing body.

15. The electrical power and/or electronic data unit of claim 14, wherein said environmental sensor is adapted to generate a signal indicative of the air temperature or humidity in the isolated work space.

16. The electrical power and/or electronic data unit of claim 15, further in combination with a data logger adapted to receive the signal indicative of the air temperature or humidity, wherein said data logger is in communication with a building automation system.

17. The electrical power and/or electronic data unit of claim 11, wherein said occupancy sensor comprises a motion sensor or an infrared sensor.

18. The electrical power and/or electronic data unit of claim 11, further comprising an electrical output conductor passing through said housing body and configured to direct electrical power to the ventilation system or the lighting system in response to the occupancy signal.

19. The electrical power and/or electronic data unit of claim 11, wherein said front face of said housing defines a plurality of openings in spaced arrangement and configured to receive said electrical power outlet and said environmental sensor, and said front face further defines a wire pass-through opening.

* * * * *